US008801375B2

(12) United States Patent
Winkler

(10) Patent No.: US 8,801,375 B2
(45) Date of Patent: Aug. 12, 2014

(54) FAN ARRANGEMENT

(75) Inventor: Wolfgang Arno Winkler, Georgen (DE)

(73) Assignee: EBM-Pabst St. Georgen GmbH & Co. KG, St. Georgen (DE)

( * ) Notice: Subject to any disclaimer, the term of this patent is extended or adjusted under 35 U.S.C. 154(b) by 956 days.

(21) Appl. No.: 10/544,811

(22) PCT Filed: Feb. 12, 2005

(86) PCT No.: PCT/EP2005/001437

§ 371 (c)(1),
(2), (4) Date: Aug. 5, 2005

(87) PCT Pub. No.: WO2005/106254

PCT Pub. Date: Nov. 10, 2005

(65) Prior Publication Data

US 2008/0089025 A1 Apr. 17, 2008

(30) Foreign Application Priority Data

Mar. 30, 2004 (DE) ..... 20 2004 005 343 U

(51) Int. Cl.
*F04D 25/08* (2006.01)
*F04D 25/12* (2006.01)
*F04D 29/44* (2006.01)

(52) U.S. Cl.
USPC ..... 415/211.1

(58) Field of Classification Search
USPC ..... 415/126, 228, 229, 203, 208.1, 211.1; 416/186 R, 189, 228, 243; 361/690, 361/694, 679.47, 695
See application file for complete search history.

(56) References Cited

U.S. PATENT DOCUMENTS

| | | | | | |
|---|---|---|---|---|---|
| 2,847,941 | A | * | 8/1958 | Jackson | 415/221 |
| 4,241,110 | A | * | 12/1980 | Ueda et al. | 427/203 |
| 4,885,488 | A | * | 12/1989 | Cox | 310/68 R |
| 5,176,509 | A | * | 1/1993 | Schmider et al. | 417/423.7 |
| 5,478,221 | A | * | 12/1995 | Loya | 417/313 |
| 5,615,998 | A | * | 4/1997 | Kodama et al. | 415/177 |

(Continued)

FOREIGN PATENT DOCUMENTS

| | | |
|---|---|---|
| DE | 92 17 333 U1 | 2/1993 |
| DE | 197 31 411 A1 | 2/1998 |
| DE | 298 22 121 U1 | 4/1999 |
| WO | WO 02-47453 A1 | 6/2002 |

OTHER PUBLICATIONS

Patent Abs. of Japan, English abstract of Hoshina/Nidec, pub. Jan. '02 as JP 2002-031088-A.

*Primary Examiner* — Edward Look
*Assistant Examiner* — Sean J Younger
(74) *Attorney, Agent, or Firm* — Milton Oliver, Esq.; Oliver Intellectual Property LLC

(57) ABSTRACT

A fan arrangement has an electric motor (18) that serves to drive a fan wheel (26; 170) and that has an internal stator (44) and an external rotor (22), with which latter the fan wheel is drivingly connected. Arranged on a circuit board (17) are components (11) that are coolable, at least in part, by an air flow (13) generated during operation by that fan wheel (26; 170). Associated with the fan wheel is an air-directing element (100) that is mounted on the circuit board (17) separately from the electric motor (18) so that, in operation, a cooling air flow (13) is generated which emerges from the fan arrangement (16) between the circuit board (17) and air-directing element (100).

25 Claims, 12 Drawing Sheets

(56) References Cited

U.S. PATENT DOCUMENTS

| | | | | | |
|---|---|---|---|---|---|
| 5,650,912 | A * | 7/1997 | Katsui et al. | 361/697 |
| 5,701,951 | A * | 12/1997 | Jean | 165/121 |
| 5,747,908 | A * | 5/1998 | Saneshige et al. | 310/91 |
| 5,794,685 | A * | 8/1998 | Dean | 165/121 |
| 5,804,895 | A * | 9/1998 | Tsuzaki et al. | 310/40 MM |
| 5,924,849 | A | 7/1999 | Kirchgessner et al. | 417/423.15 |
| 5,943,209 | A * | 8/1999 | Liu | 361/695 |
| 5,997,183 | A | 12/1999 | Horng | 384/517 |
| 6,013,966 | A * | 1/2000 | Fehrenbacher et al. | 310/257 |
| 6,023,413 | A * | 2/2000 | Umezawa | 361/697 |
| 6,027,307 | A * | 2/2000 | Cho et al. | 415/173.5 |
| 6,116,856 | A * | 9/2000 | Karadgy et al. | 416/203 |
| 6,118,658 | A * | 9/2000 | Nakase | 361/697 |
| 6,135,200 | A * | 10/2000 | Okochi et al. | 165/121 |
| 6,137,680 | A * | 10/2000 | Kodaira et al. | 361/697 |
| 6,190,135 | B1 | 2/2001 | Winkler | 416/247 R |
| 6,196,300 | B1 * | 3/2001 | Checchetti | 165/80.3 |
| 6,206,087 | B1 * | 3/2001 | Nakase et al. | 165/80.3 |
| 6,219,236 | B1 * | 4/2001 | Hirano et al. | 361/695 |
| 6,254,343 | B1 * | 7/2001 | Schmidt et al. | 415/222 |
| 6,301,111 | B1 * | 10/2001 | Katsui | 361/697 |
| 6,328,529 | B1 * | 12/2001 | Yamaguchi et al. | 415/178 |
| 6,336,745 | B1 * | 1/2002 | Horng et al. | 384/279 |
| 6,358,011 | B1 * | 3/2002 | Tetu et al. | 416/186 R |
| 6,460,608 | B1 * | 10/2002 | Katsui | 165/80.3 |
| 6,501,652 | B2 * | 12/2002 | Katsui | 361/697 |
| 6,509,704 | B1 | 1/2003 | Brown | 318/254 |
| 6,736,192 | B2 * | 5/2004 | Chang | 165/80.3 |
| 6,737,786 | B2 * | 5/2004 | Hsu | 310/254.1 |
| 6,747,865 | B2 | 6/2004 | Capriz et al. | 361/679 |
| 6,841,957 | B2 * | 1/2005 | Brown | 318/400.01 |
| 6,927,979 | B2 * | 8/2005 | Watanabe et al. | 361/697 |
| 6,948,912 | B2 * | 9/2005 | Chang et al. | 416/185 |
| 7,249,931 | B2 * | 7/2007 | Parker et al. | 415/221 |
| 2002/0056547 | A1 | 5/2002 | Shingai et al. | 165/121 |
| 2002/0196607 | A1 | 12/2002 | Capriz et al. | 361/710 |
| 2005/0122682 | A1 | 6/2005 | Streit et al. | 361/695 |

* cited by examiner

FAN ARRANGEMENT

This application is a §371 of PCT/EP2005/001437, filed 12 Feb. 2005, claiming priority from German application DE 20 2004 005 348.8, filed 30 Mar. 2004, which is hereby incorporated by reference.

FIELD OF THE INVENTION

The invention concerns a fan arrangement, such as a mini-fan. Such fans are also referred to as miniature or subminiature fans.

BACKGROUND

Miniature fans have very small dimensions. For example:

fans of the ebm-papst 250 series have dimensions of 8×25×25 mm;

those of the ebm-papst 400F series, 10×40×40 mm;

those of the ebm-papst 400 series, 20×40×40 mm; and those of the ebm-papst 600 series, 25.4×60×60 mm.

The power consumption of such fans is 0.4-0.6 W for the 250 series, 0.7-0.9 W for the 400F series, and 0.9-1.6 W for the 400 and 600 series. Their typical weight is approximately in the range from 4 to 35 grams.

Electronic devices today are being equipped with more and more functions and installed in smaller and smaller housings. This causes an increase in waste heat in the electronic circuit of such a device. One particular problem arises from the fact that in such a circuit, individual elements become particularly hot, e.g. power semiconductors, microprocessors, resistors with which a motor current is measured, etc. These particularly hot elements generate on the circuit board so-called "hot spots," a term borrowed from geology: Iceland, for example, has many hot spring and geysers, i.e. many hot spots.

Cooling such hot spots with ordinary equipment fans is inefficient, since equipment fans such as those used, for example, in computers generate a relatively diffuse air flow that removes sufficient heat from the housing, but does not allow targeted cooling of individual hot spots.

SUMMARY OF THE INVENTION

It is therefore an object of the invention to make available a new fan arrangement that is particularly suitable for targeted cooling on a circuit board or the like.

According to the invention, this object is achieved by mounting the fan and the components to be cooled on the same board, and providing an air-directing element, associated with the fan wheel, in a location such that, together with the board, it directs airflow over the components to be cooled. A fan arrangement of this kind can be arranged directly on a circuit board at the location where the greatest waste heat is generated. Collectorless control or regulation of the electric motor of such a fan arrangement can be accomplished by means of switch elements that are integrated into the electronics on the circuit board that is to be cooled. These switch elements can also modify the rotation speed of such a fan arrangement as a function of temperature, so that the rotation speed increases with rising temperature.

It is particularly advantageous that such a fan arrangement makes possible a very low overall height, because its bearing unit and the internal stator of its electric motor can be installed and soldered directly onto the circuit board, similarly to an electronic component, and because the air-directing ring can be installed on the circuit board as a separate unit, so that the circuit board in fact becomes a component of the fan and the latter's overall height is correspondingly reduced. This allows the use of taller fan wheels and thus an increase in air output.

When the installation operations are complete, the fan wheel can be installed and secured against being pulled off. This also makes it possible to install the fan wheel, which in such miniature fans is very sensitive, at a point in time at which damage to it can be largely ruled out.

By appropriate configuration of the air-directing ring, either the emerging cooling air can be directed in targeted fashion onto specific components, or the air can emerge uniformly in all directions and uniformly cool all the surrounding components. This yields a very large number of possibilities for variation.

In addition to the rotation speed of such a mini-fan, the conformation of its fan vanes is also of great importance in terms of achieving high cooling capacities. The number of vanes, their angle of incidence with respect to the hub, and the vane radius are important variables. If an axial fan wheel is used, good results are achieved by using approximately trapezoidal fan blades. A radius-shaped vane curvature in the radial direction can also be advantageous.

A radial fan wheel has particular advantages for applications on circuit boards. The fan vanes are preferably embedded into an upper and a lower air guidance plate, resulting in optimum air guidance. The air guidance plates here are what impart the characteristics of a diagonal fan, and have corresponding cross-sectional profiles.

In such a case it may be advantageous to mount a stationary air guidance plate on the circuit board, so that slightly more-distant hot spots on the circuit board can be reached. There will also be cases, however, in which such air guidance plates can be omitted, specifically when only heat sources located in the immediate vicinity of such a mini-fan need to be cooled.

BRIEF FIGURE DESCRIPTION

Further details and advantageous refinements of the invention are evident from the exemplifying embodiments, in no way to be understood as a limitation of the invention, that are described below and depicted in the drawings.

In the Drawings

DETAILED DESCRIPTION

Figure 1:
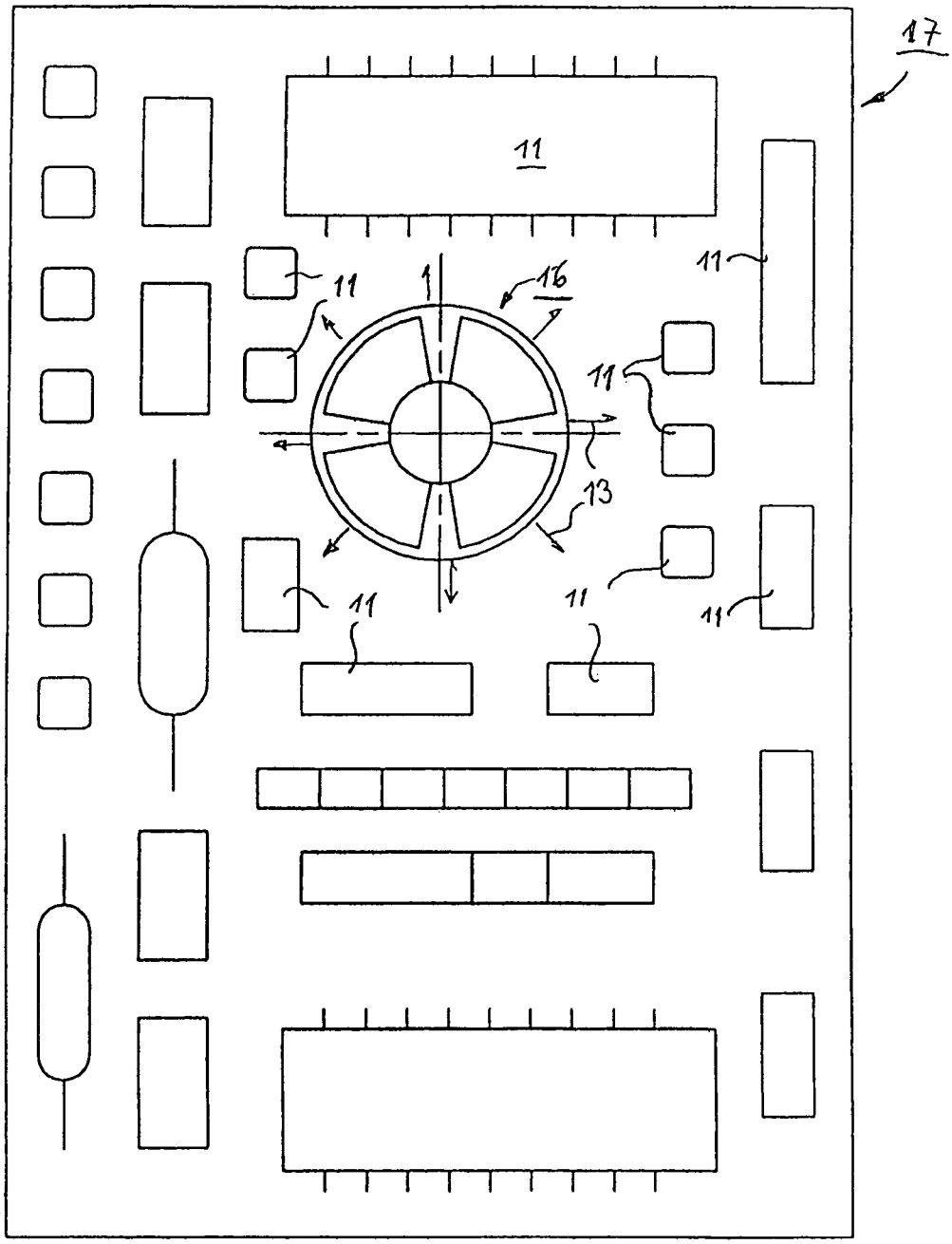
FIG. 1 is a plan view of a circuit board 17 on which a fan arrangement 16 for local heat dissipation is arranged at a point having particular high heat evolution.

FIG. 1 is a plan view of a circuit board 17 on which various electronic components are arranged. Located in the upper half are components 11 that generate a particularly large amount of heat, and therefore a hot spot, during operation. A fan arrangement 16, of the kind that will be described in more detail later with reference to examples, is located approximately at the center of this hot spot. Fan arrangement 16 brings about targeted cooling of components 11 because it generates a uniform air flow 13 in all directions. It is depicted only schematically in FIG. 1. Preferred embodiments are evident from the subsequent Figures.

It should be noted that air flow 13 can also be directed in targeted fashion onto individual components, and that the air flow can be correspondingly reduced in sectors where little cooling air is needed. In FIG. 1 these would be, for example, the sectors between 4 and 5 o'clock and between 8 and 9 o'clock, where the density of components 11 is relatively low and consequently less heat needs to be dissipated. This control of the air flows is possible, for example, using panels, or in many other ways. The reader is referred for that purpose to the technical literature.

Figure 2:
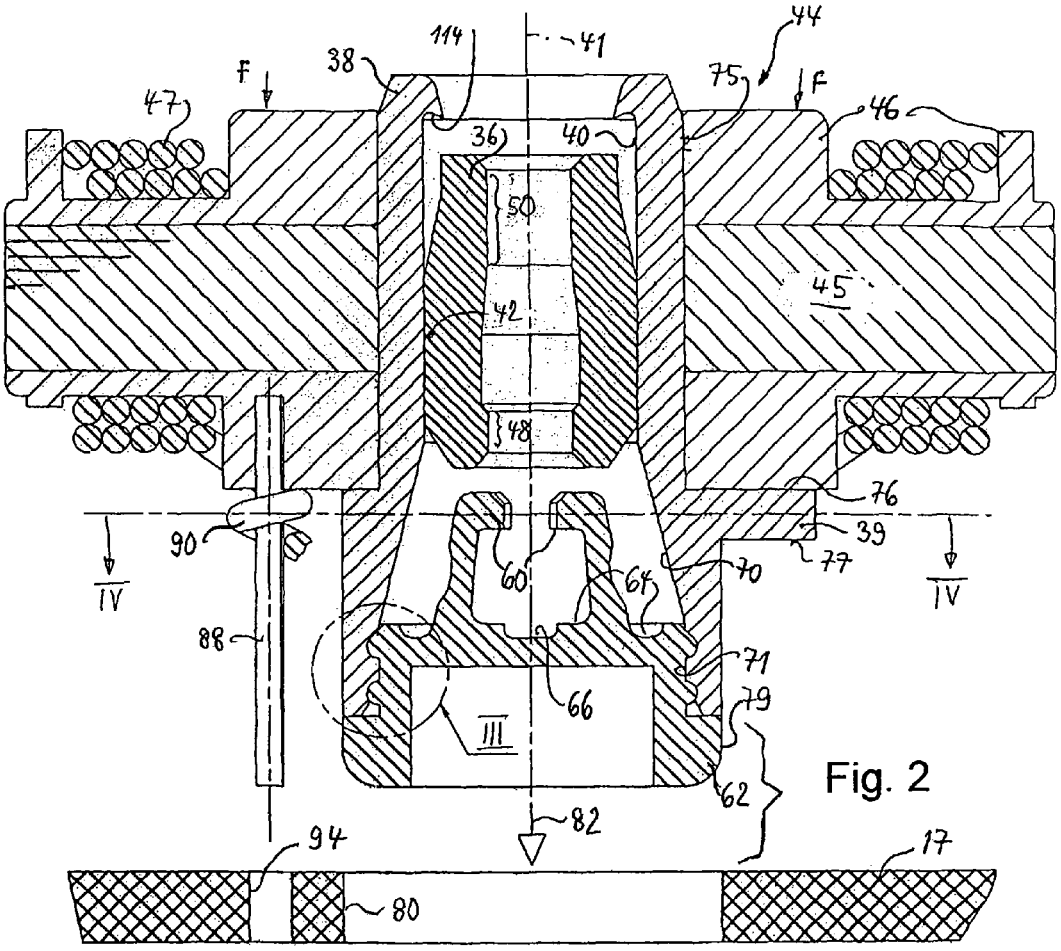
FIG. 2 is a section through a circuit board and through the internal stator of a mini-fan that is to be mounted on that circuit board, at greatly enlarged scale.

Mini-fan 16 is driven by an external-rotor motor 18 (FIG. 8), and FIG. 2 shows circuit board 17 on which stator 44 of motor 18 is mounted.

Figure 7:
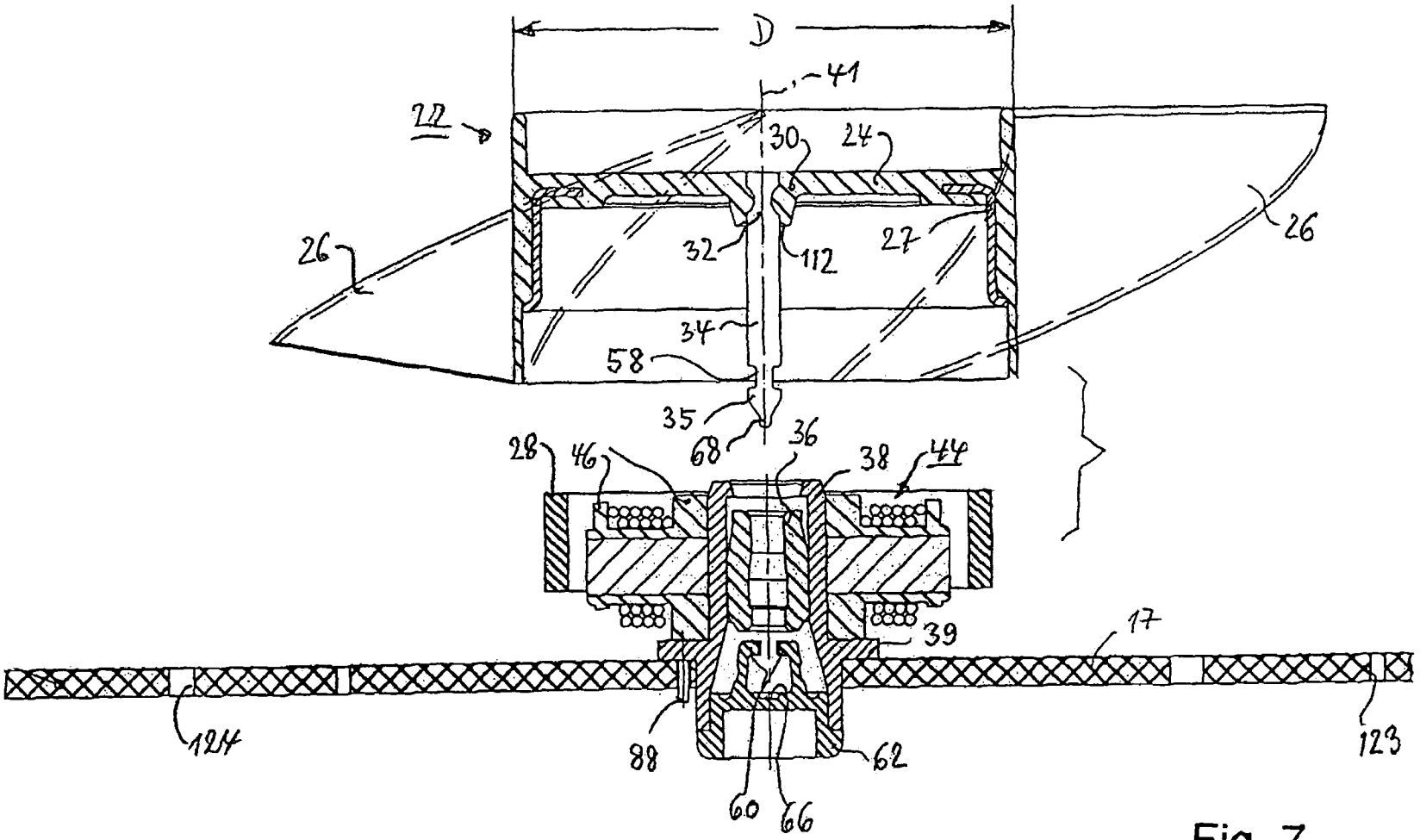
FIG. 7 is a depiction analogous to FIG. 6, the rotor that belongs to the internal stator (and the fan wheel connected to that rotor) additionally being depicted before installation.
Figure 8:
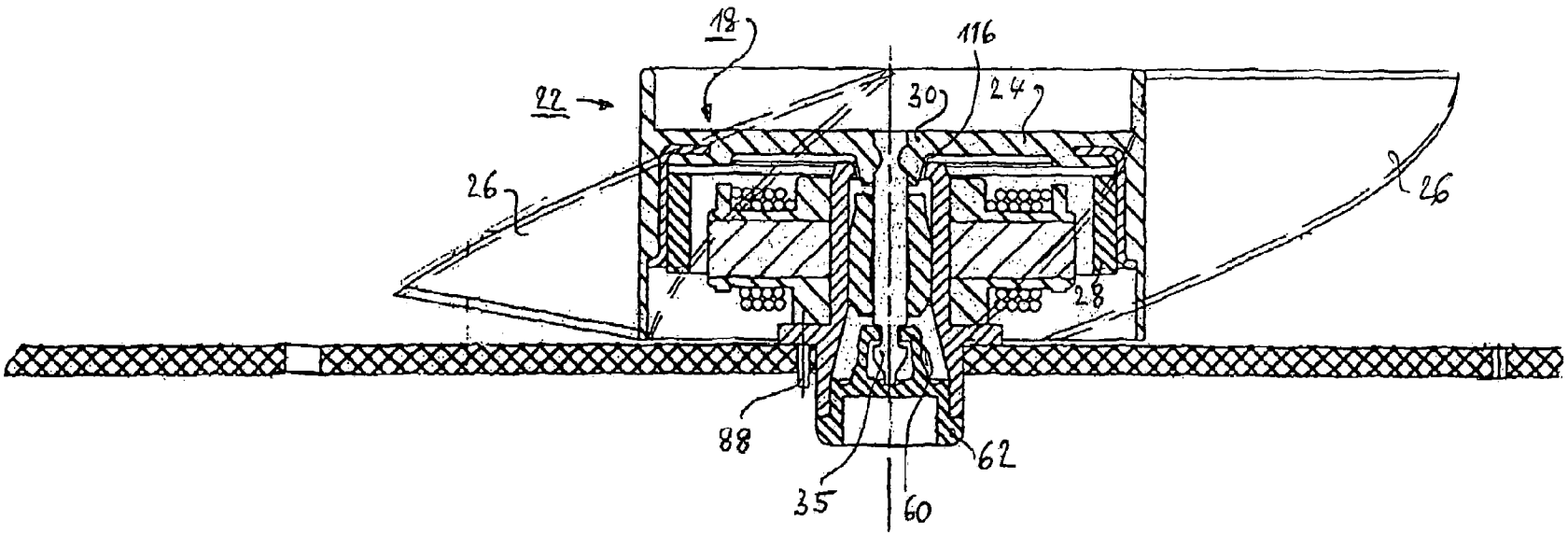
FIG. 8 is a depiction analogous to FIG. 7 but after mating of the internal stator and rotor.

According to FIGS. 7 and 8, motor 18 has an external rotor 22 having a rotor cup 24 on whose outer periphery are provided fan blades 26 that are also referred to as fan vanes. A magnetic yoke 27 made of soft iron is located in rotor cup 24, and on the yoke's inner side is located a radially magnetized rotor magnet 28 (FIG. 8) that can be magnetized with, for example, four poles. Outside diameter D (FIG. 7) of external rotor 22 can be, for example, in the range from approximately 14 to approximately 35 mm. Application of the invention to larger motors as well is not excluded, of course, but this range represents the principal field of application.

Rotor cup 24 has at its center a hub 30 in which is mounted in thermally conductive fashion, by plastic injection molding or the like, a correspondingly shaped upper shaft end 32 of a rotor shaft 34 whose lower, exposed shaft end is labeled 35. The diameter of end 35 decreases toward the bottom.

A plain bearing 36, which preferably is implemented as a double sintered bearing, provides radial support for shaft 34. Support using rolling bearings is also possible, in order to achieve particularly a long service life. Plain bearing 36 is mounted in a bearing tube 38 by being pressed in. Bearing tube 38 is preferably made of steel, brass, or another suitable material. The use of a plastic is also not excluded. Bearing tube 38 is equipped with a radial projection in the form of a flange 39 that, in this example, extends approximately perpendicular to rotation axis 41 of rotor 22. Internal stator 44 of motor 20 is mounted on the outer side of bearing tube 38, preferably by being pressed on (see FIG. 2).

Sintered bearing 36 has a bulging portion 42 having a diameter that corresponds approximately to the diameter of a cylindrical portion of inner side 40 of bearing tube 38, and is dimensioned so that a tight fit is obtained upon installation.

As depicted in FIG. 2, sintered bearing 36 has a lower plain bearing portion 48 and an upper plain bearing portion 50. This allows reliable support of shaft 34 and a correspondingly long service life for motor 20, even at the high rotation speeds of these mini-fans which are often in the range from 6,000 to 9,000 rpm.

Stator 44 has, in the usual way, a lamination stack 45 that is injection-embedded into a coil former 46 onto which a winding 47 is wound. As an alternative to the embodiment shown here with salient poles, stator 44 could also, for example, be implemented as a claw pole stator.

Shaft 34 has at its exposed end region 35 an annular groove 58, which is depicted in FIG. 7 and into which flexible retaining hooks 60 are latched after installation (see FIG. 8). These hooks 60 have a smaller axial extension than annular groove 58, and their function is to secure rotor 22 against inadvertently being pulled out.

Flexible latching hooks 60 do not come into contact against shaft 34 at any point. They are implemented integrally with a cover 62 and are located on a lubricant repository 64 on whose bottom is located a depression 66 in which a tracking cap 68 (FIG. 7) of shaft 34 rotates. Depression 66 and tracking cap 68 together constitute a thrust bearing for shaft 34.

Figure 3:
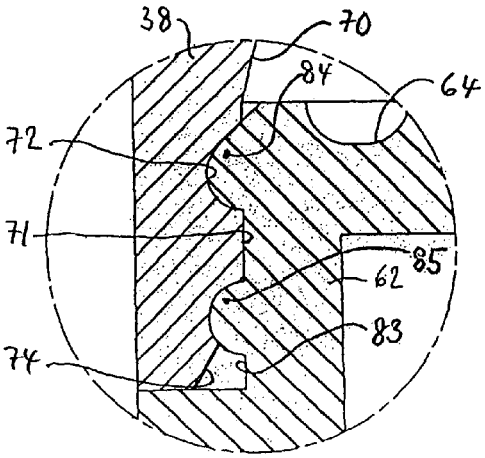
FIG. 3 is a further enlarged depiction of a detail III of FIG. 2.

As FIG. 2 shows with particular clarity, bearing tube 38 has in its upper region a hollow cylindrical portion 42, and the latter widens toward the bottom in the manner of a hollow truncated cone 70 that transitions at the bottom into an approximately cylindrical portion 71 in which are recessed annular grooves 72, 73 having an approximately semicircular cross section (see FIG. 3). Toward the bottom, cylindrical portion 71 widens in the manner of a hollow truncated cone 74. On its outer side, bearing tube 38 has at the top a cylindrical portion 75 onto which internal stator 44 is pressed (see FIG. 2), and portion 75 transitions via a shoulder 76 into the upper side of flange 39. The latter forms a stop for coil former 46 upon installation (see FIG. 2).

Figure 6:
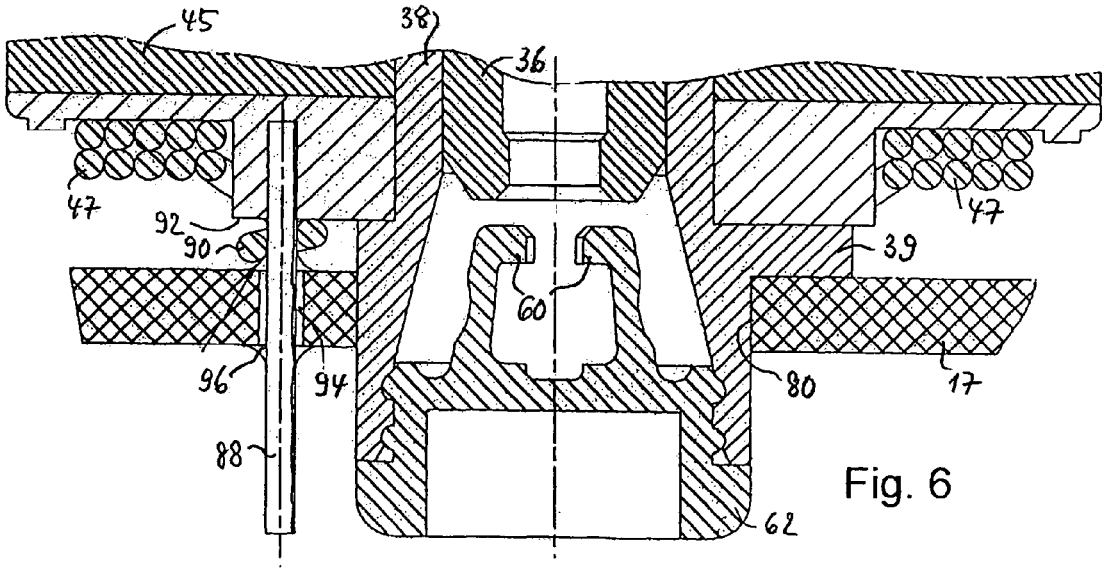
FIG. 6 is a depiction analogous to FIG. 2, in which the circuit board and the internal stator are mechanically and electrically connected to one another.

Lower side 77 of flange 39 transitions in turn into a cylindrical portion 78 on the outer side of bearing tube 38. This portion 78 has a larger diameter than portion 75, and it continues into cylindrical outer side 79 of latching cover 62, so that bearing tube 38 and latching cover 62 together form a cylindrical outer side that, according to FIGS. 2 and 6, is implemented to be pressed into a cylindrical opening 80 of circuit board 17.

This enables simple installation, but requires that (as shown in FIG. 2) an axial force F be exerted in a downward direction on coil former 46, i.e. installation in opening 80 must occur before rotor 62 is installed. The invention makes this possible without difficulty, i.e. firstly (as shown in FIG. 2) the part having internal stator 44 is pressed in the direction of an arrow 82 into opening 80, and then, at a later point in time, the motor is completed by inserting rotor 22 (as shown in FIGS. 7 and 8).

As FIG. 3 shows, latching cover 62 has on its outer side 83 latch ridges 84, 85 that are visible only in this enlarged depiction. When latching cover 62 is pressed with a press fit into opening 71, ridges 84, 85 create a slight latching effect and at the same time constitute an excellent seal, so that no lubricant can leak out of repository 64. The flexible plastic used for cover 62 is sufficiently heat-resistant that it is not damaged by passage through a soldering bath.

Figure 4:
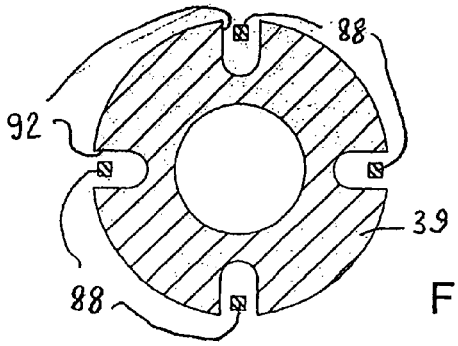
FIG. 4 shows a first alternative of a section, viewed along line IV-IV of FIG. 2.
Figure 5:
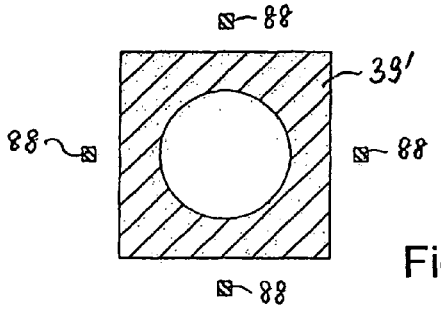
FIG. 5 shows a second alternative of section IV-IV.

Four wire pins 88, to which terminals 90 of winding 47 are connected, are mounted in coil former 46 at regular 90° intervals. The winding usually contains two phases, namely a drive winding and a sensor winding. For the passage of pins 88, flange 39 has either the shape according to FIG. 4 with four radial grooves 92, or the square shape 39' shown in FIG. 5. Circuit board 17 has corresponding holes 94 into which these wire pins 88 are introduced upon installation and then soldered with a solder 96 in the solder bath, in which context solder 96 rises upward by capillary action through hole 94 and also solders winding terminal 90 to pin 88. This solder 96 then simultaneously constitutes the electrical connection and a mechanical connection between internal stator 44 and circuit board 17. This simple type of mounting is possible because a mini-fan of this kind weighs, for example, only 20 g.

Hub 30 has at its lower end (in FIG. 7) an undercut 112 that slings lubricant outward. Bearing tube 38 likewise has, at its upper end on the inner side, an undercut 114 that prevents lubricant from running out of fan 16 when the latter is in an oblique position. For this reason, gap 116 between bearing tube 38 and rotor 22 is also very narrow and is dimensioned in the manner of a capillary gap, in order to prevent the discharge of lubricant. Lubricant slung outward by undercut 112 flows downward along inner wall 46 of bearing tube 38 to sintered bearing 36, and through the latter farther downward into reservoir 64. The result of this is that a sufficient supply of lubricant is always present in reservoir 64 and its depression 66.

Installation

As shown in FIGS. 2 and 6, firstly cylindrical part 71, 79 of bearing tube 38 is pressed into opening 80 of circuit board 17, resulting in the image shown in FIGS. 6 and 7. In this state, circuit board 17 is soldered in the usual way in a solder bath. (Components 11 are not depicted in FIG. 2 and following.)

Then, as shown in FIGS. 7 and 8, rotor 22 is mated to internal stator 44; in this process, as shown in FIG. 8, retaining elements 60 are first deflected outward and then snap into annular groove 58 of rotor shaft 34, thus preventing rotor 22 from being pulled out again. To prevent frictional losses, retaining elements 60 do not make contact against annular groove 58. This increases the efficiency of a miniature or subminiature motor of this kind.

For transport, rotors 22 can be transported separately and installed only on site, in which context appropriate lubricant must first be placed into repository 64, 66. Transport with rotors 22 installed is also possible.

Figure 10:
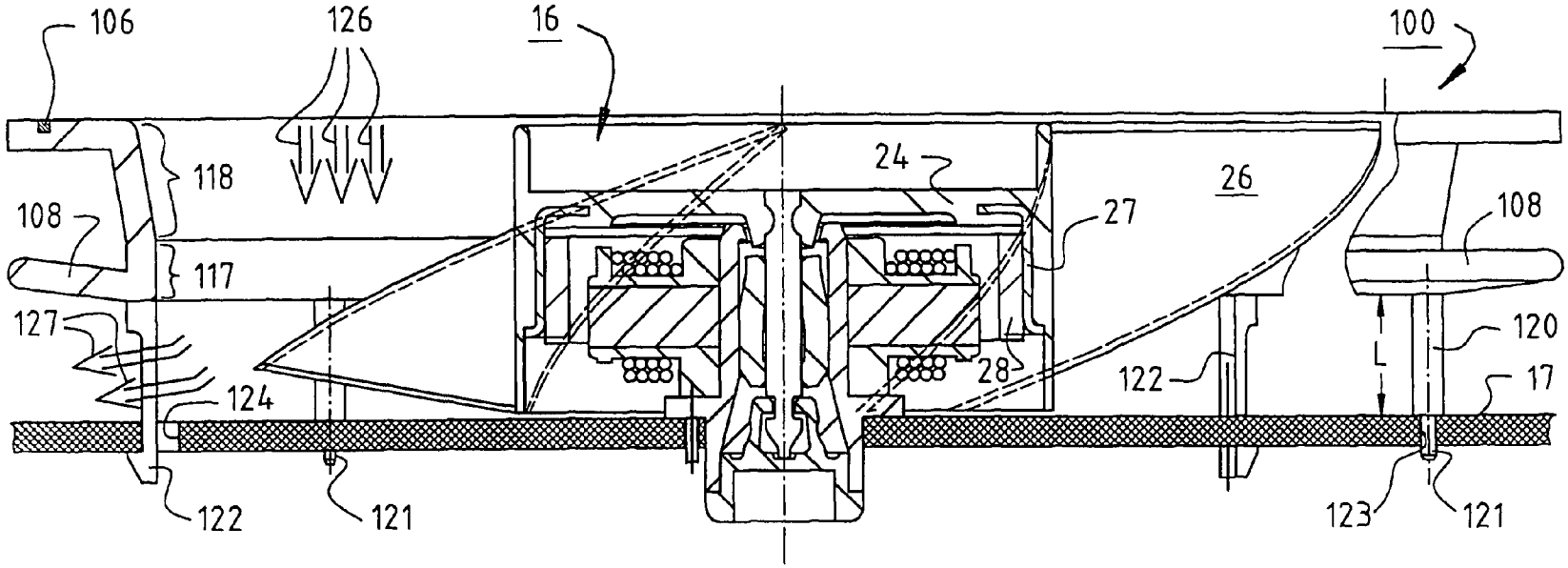
FIG. 10 is a depiction analogous to FIG. 9 but after installation of the air-directing ring on the circuit board.

Because magnet 28, as depicted in FIG. 10, is not arranged symmetrically with respect to stator laminations 45 in terms of the axial direction of motor 20, but instead is offset upward with respect to them, a magnetic force acts in a downward direction on rotor 22; this presses tracking cap 68 into depression 66 and prevents the rotor from rattling in response to impacts.

Subsequent to installation, fan 16 is tested in the usual way. Commutation can be accomplished, for example, by means of the induced voltage, for which purpose a corresponding sensor winding is provided; or a semiconductor sensor is used that senses the position of rotor 22.

Figure 9:
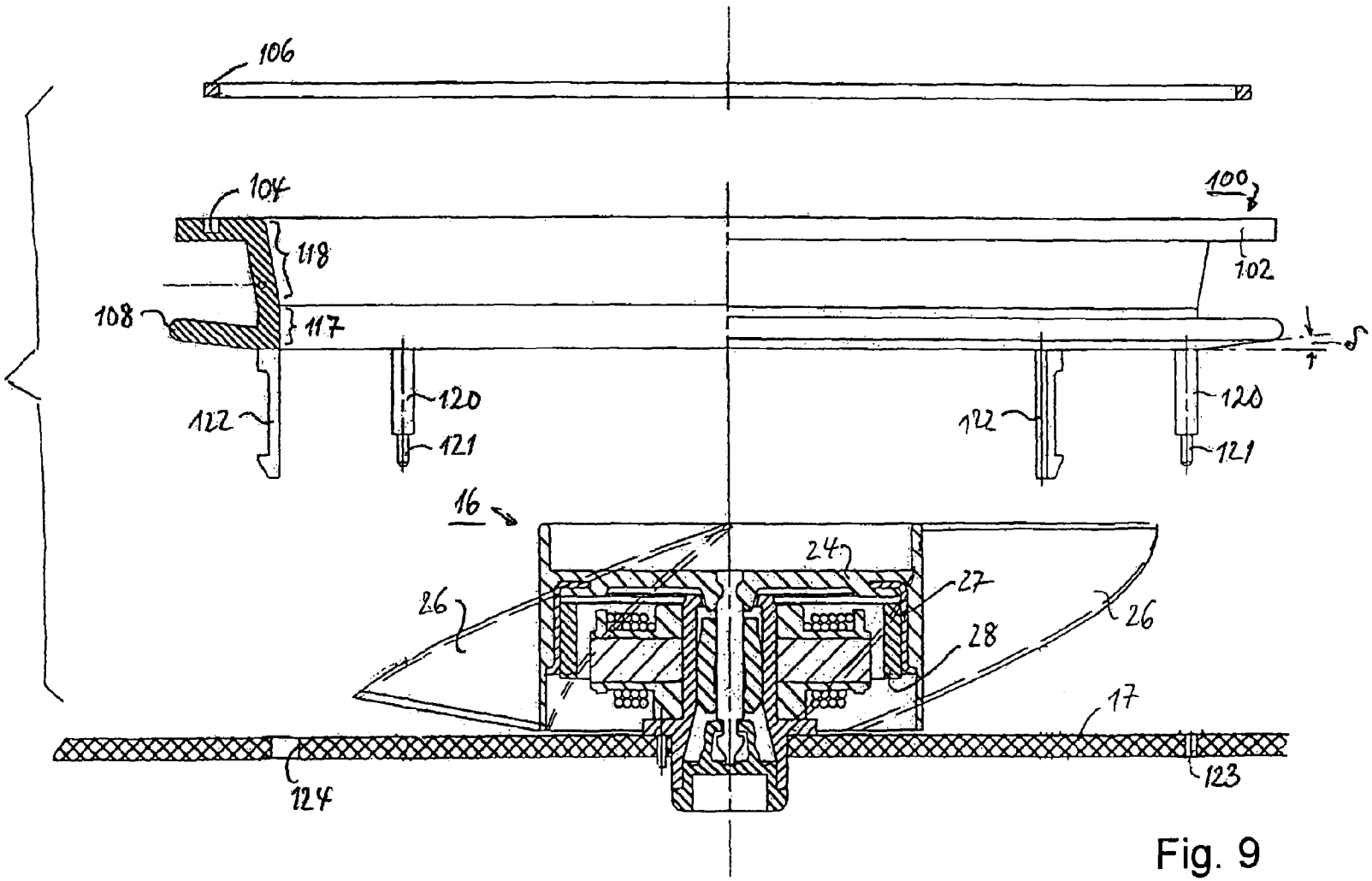
FIG. 9 is a depiction analogous to FIG. 8 showing the circuit board, the fan mounted on it, and an air-directing ring, the latter being depicted before its installation on the circuit board, in section to the left and unsectioned to the right.

As depicted in FIG. 9, an air-directing element 110 is provided that is installed, as shown in FIG. 10, around fan 16 in order to improve its efficiency. This element is also referred to as an air-directing nozzle 100, or air nozzle, or as the outer housing of the fan.

It has an upper, annular flange 102 that is equipped with an annular groove 104 for a sealing ring 106. It furthermore has a lower flange 108 that, as depicted, is tilted upward at an angle δ (delta), e.g. at 7°. Annular flanges 104, 108 are connected to one another by a tubular portion whose lower part 117 is implemented cylindrically and whose upper part 118 has the shape of a hollow truncated cone that widens toward the top. This shape brings about a Venturi effect and improves fan performance.

Three spacing elements 120, as well as three latching hooks 122, are provided on lower flange 108. Because of the partially sectioned depiction, FIG. 9 shows only two spacing elements 120 and two latching hooks 122.

As shown in FIG. 10, air-directing element 100 is hooked by means of its latching hooks 122 into corresponding recesses 124 of circuit board 17, spacing elements 120 being inserted with lower, pin-shaped, smaller-diameter portions 121 into corresponding recesses 123 of circuit board 17, and holding air-directing element 100 at a predetermined distance L (FIG. 10) from circuit board 17. This type of mounting is very simple and reliable.

As FIG. 10 shows, during operation air is drawn in along arrows 126 in a vertical direction, and then blown out between circuit board 17 and lower flange 108 in an approximately horizontal direction (arrows 127) in all directions, i.e. all the surrounding components 11 (FIG. 1) are cooled in the same manner.

Figure 11:
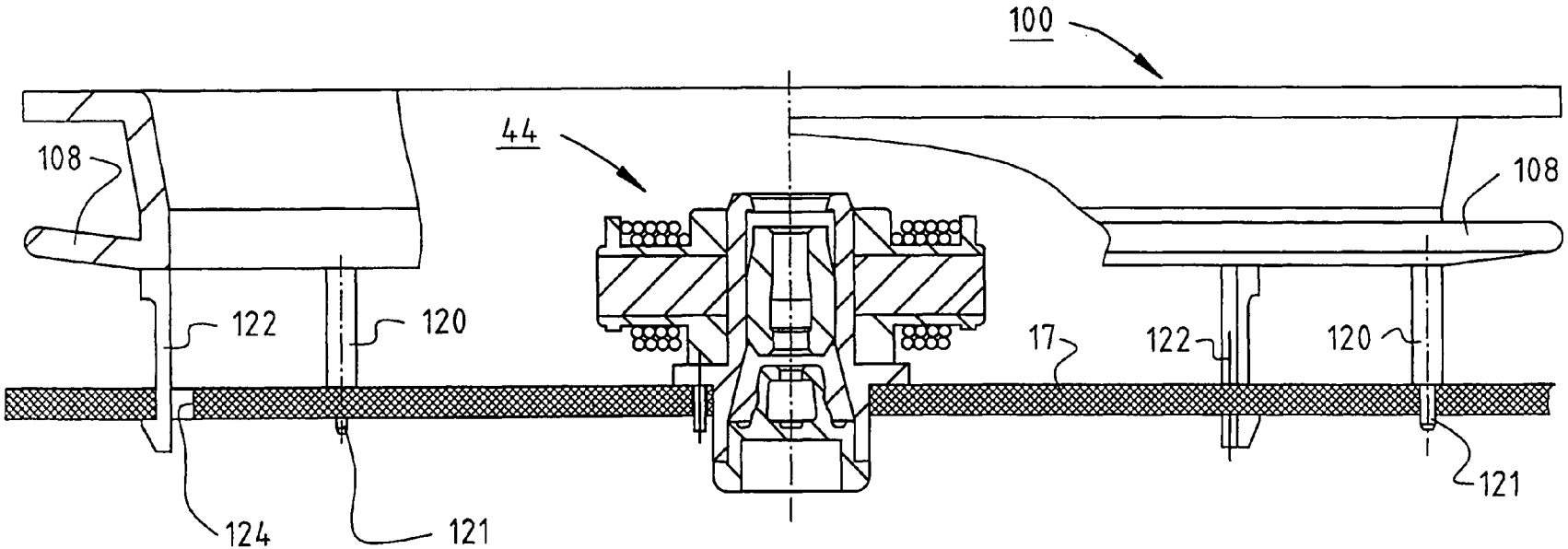
FIG. 11 shows a variant in which the air-directing ring has been installed on the circuit board before the rotor is installed; this variant can be very advantageous in many cases.

As an alternative, as shown in FIG. 11, after the installation of internal stator 44 on circuit board 17, firstly air-directing ring 100 can be installed in the manner described, and only then is rotor 22 installed. The advantage is that in this case rotor 22 cannot be damaged during the installation of air-directing ring 100. In miniature and subminiature fans of this kind, rotor 22 is particularly sensitive because of its extremely thin shaft 34 and its small, almost toy-like, size and must be handled as carefully as a fresh egg. In FIG. 11, in this case rotor 22 is inserted through the opening of air-directing ring 100, the latter serving as a guide.

Figure 12:
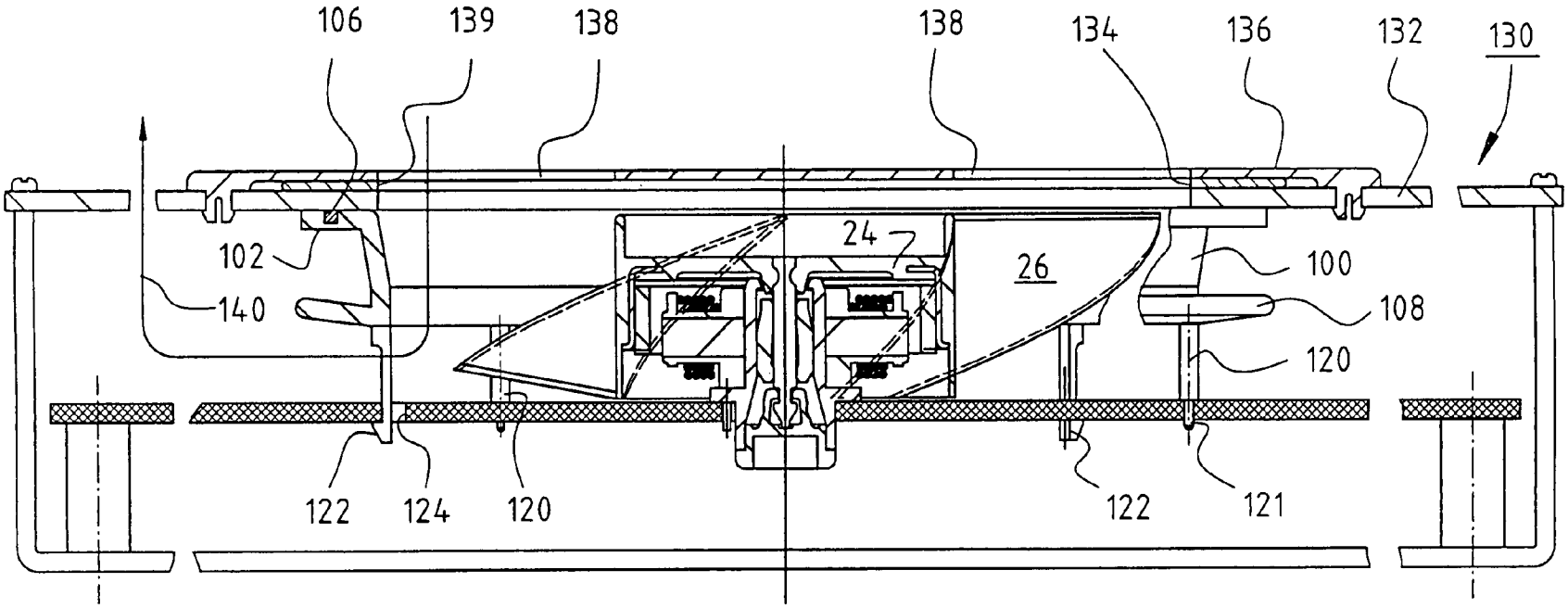
FIG. 12 shows the arrangement according to FIG. 10 after its installation in the housing of an electrical device.

FIG. 12 shows the arrangement according to FIG. 10 after installation into an electronic device 130. In this case flange 102 rests with its sealing ring 106 against upper (in FIG. 12) housing wall 132 that has in the center an air entrance opening 134 of the same size as the upper opening of air-directing ring 100.

A protective lattice 136 that is equipped with a plurality of openings 138 is latched onto wall 132. A dust filter 139 can additionally be located below protective lattice 136, for example to prevent the penetration of sand or animals. The path of the air that is drawn in is indicated at 140. Air can also, if applicable, emerge from device 130 laterally through corresponding openings.

Figure 13:
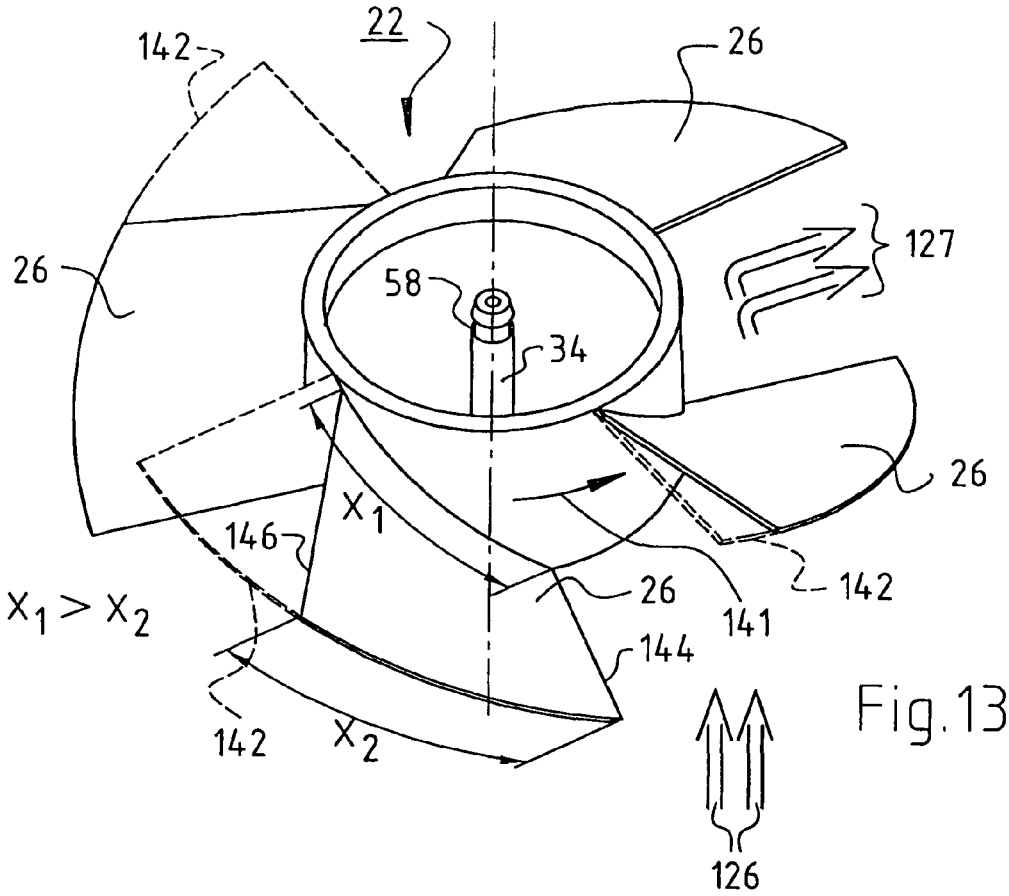
FIG. 13 is a highly schematic three-dimensional depiction of the fan rotor for the motor of FIG. 10.
Figure 14:
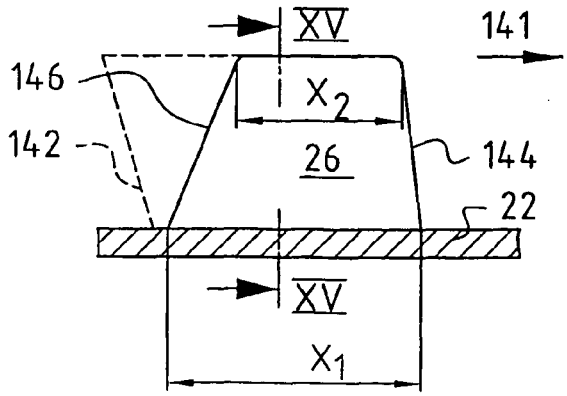
FIG. 14 is a developed view of a fan blade 26 of FIG. 13.
Figure 15:
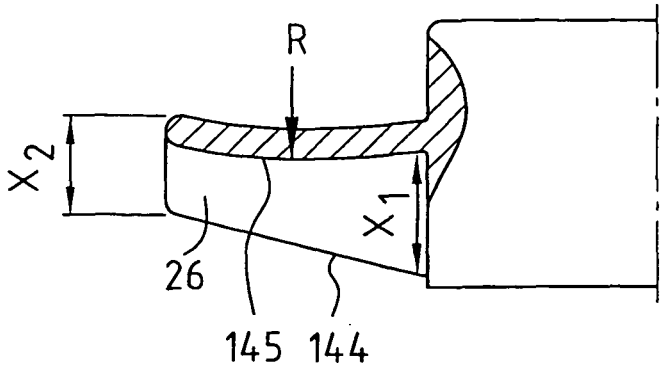
FIG. 15 is a radial section through a blade 26 of the rotor of FIG. 13.

FIGS. 13 through 15 show a preferred shape of fan vanes 26 for an axial fan wheel such as the one depicted in FIG. 13. In addition to the fan's rotation speed and its number of blades, their angle of incidence relative to the hub, and the blade radius, the axial length of the blades and their geometry is also very important specifically for such small fans.

FIG. 13 shows rotation direction 141. Fan blades 26 extend axially over the entire length of rotor 22. FIG. 13 shows for comparison, using dashed lines, the "normal" shape of such blades. In the present case, rear portion 142 (viewed in the rotation direction) of normal blades 26 is not present, yielding an approximately trapezoidal blade shape. The reason for this shape of blades 26 deviating from the "normal" shape is that it facilitates a lateral outflow of the delivered air as depicted in FIG. 13 at 127, i.e. the pressure buildup in the lateral direction is improved. With the "normal" blade geometry only a small pressure buildup in the lateral direction, and consequently only a small cooling air flow onto circuit board 17, would be obtained.

If the dimension of a blade 26 along the outer side of rotor 22 is labeled $x_1$ and the dimension of the blade along its outer circumference $x_2$, as depicted in FIG. 13, then here x1>x2, i.e. x1 represents the base of a trapezoid.

FIG. 14 shows a blade of this kind in a developed view, the leading edge being labeled 144 and the trailing edge 146. Rotation direction 141 is also indicated.

FIG. 15 shows a section viewed along line XV-XV of FIG. 14. It is apparent that blades 26 are also curved when viewed in radial section, and have a radius of curvature R.

R preferably has a value that is less than or equal to $x_1$. Convex side 145 of each blade 26 faces toward air entrance side 126. Curvature R causes a slight reduction in pressure buildup, but the radial outflow of the air (arrows 127 in FIG. 13) is thereby improved. This curvature (radius R) advantageously promotes pressure buildup in the region of air-directing ring 100.

Figure 16:
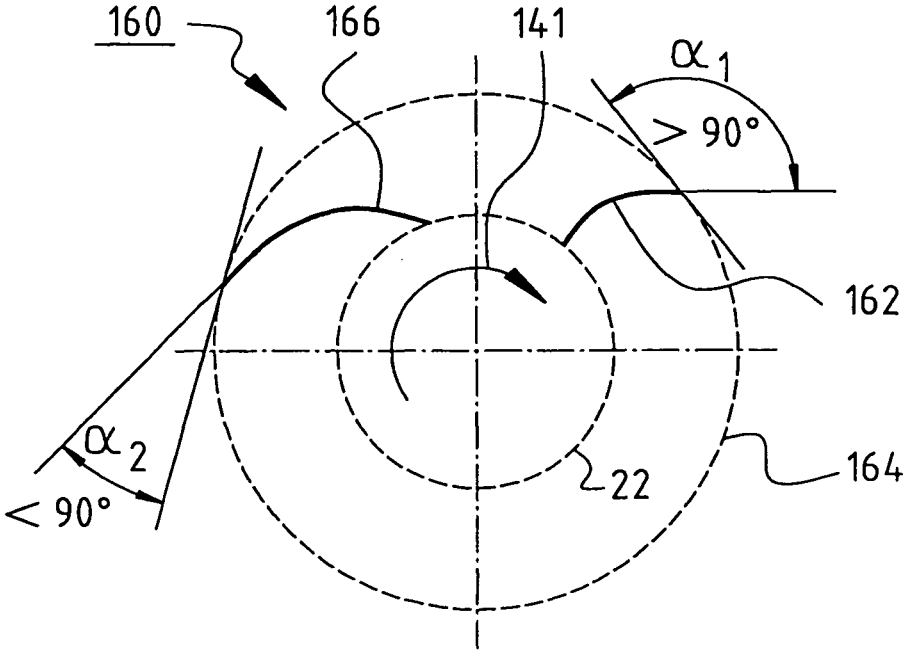
FIG. 16 is a schematic depiction to explain FIG. 17.

FIG. 16 schematically shows a radial fan wheel 160 that is rotating clockwise as indicated by arrow 141. Proceeding from external rotor 22 is a radial fan vane 162 that is curved forward, and its radially outer portion encloses, with respect to periphery 164 of fan wheel 160, an angle $\alpha_1$ (alpha1) that is greater than 90°.

Also indicated in FIG. 16, for comparison, is a radial fan vane 166 that is curved backward, i.e. its radially outer portion encloses, with respect to periphery 164, an angle $\alpha_2$ (alpha2) that is less than 90°.

Vanes 162 that are curved forward generate a more pronounced deflection of the flow, i.e. a greater conversion of energy into moving air. They require a helical housing, however, and pressure can only be built up using a diffuser placed downstream from such an impeller having vanes 162.

By contrast, a fan wheel 160, having vanes 166 curved backward, generates the pressure in the fan wheel itself, so that a helical housing and a diffuser can be dispensed with; this means a great simplification in the case of fans for cooling circuit boards, and enables an air flow in all directions.

Figure 17:
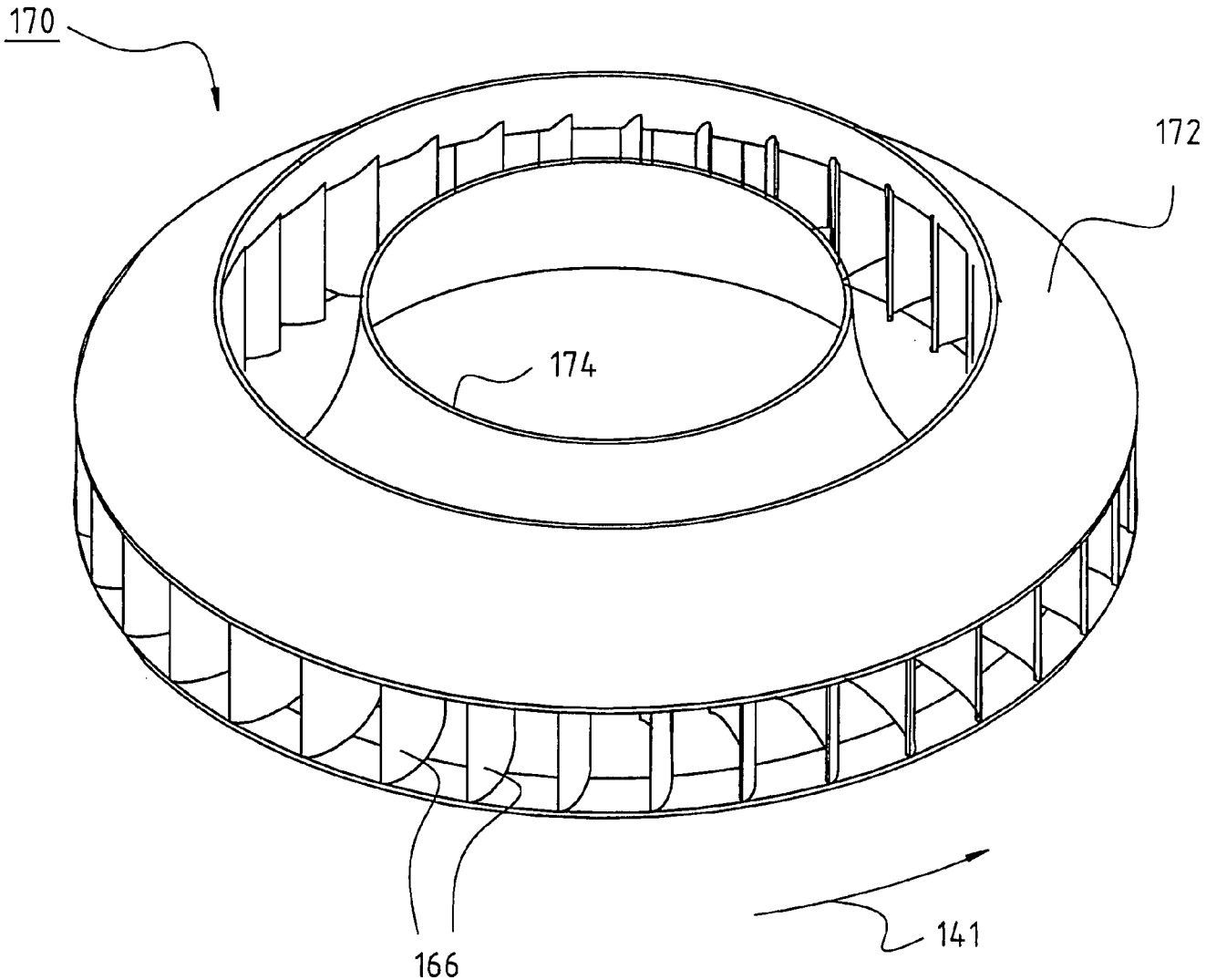
FIG. 17 is a three-dimensional depiction of a rotor that can preferably be used in the fan arrangement according to FIG. 12.

FIG. 17 shows a preferred embodiment of a radial fan wheel 170 of this kind having vanes 166 curved backward, i.e. ones in which the convex side rotates forward, for which reason a helical housing and a diffuser can be omitted here. An air-directing ring such as the one depicted in FIG. 9 is advantageously used here as well, although only part 108 is needed and portions 102 and 118 can be omitted.

Fan wheel 170 has an upper air guidance plate 172 having a curved cross section, the preferred cross-sectional shape of which corresponds approximately to the sector of an ellipse. Fan wheel 170 furthermore has a lower air guidance plate 174 that extends, viewed in cross section, approximately parallel to upper plate 172. Both plates extend as far as air inlet opening 134, the upper edge of plate 172 being arranged very close to the edge of opening 134.

Fan vanes 166 are embedded in the region of the outlet between plates 172, 174 in the manner depicted, and are curved backward (see FIG. 17), i.e. the pressure buildup occurs here in the fan wheel itself.

A stationary air guidance plate 108, which is aligned with the outer edge of upper air guidance plate 172 and together with circuit board 17 forms an air passage conduit that widens somewhat toward the outside, is preferably arranged around fan wheel 170. It is thereby possible to generate a targeted air flow, so that even more-distant components 11 can be cooled. If all the components 11 to be cooled are located in the vicinity of the fan, it is then optionally possible to dispense with stationary air guidance plate 108. The latter is mounted in exactly the same way as air guidance member 100 of the first exemplifying embodiment, i.e. using the same latching hooks and spacing elements, which therefore will not be described again. Here again, the installation of air guidance plate 108 is extraordinarily simple.

Many variants and modifications are, of course, possible within scope of the present invention.

What is claimed is:

1. A fan arrangement adapted for use in association with a circuit board (17) formed with a first opening (80) and bearing a plurality of heat-generating components (11), the fan arrangement comprising an electric motor (18) serving, in operation, to drive a fan wheel (26; 170);

an air-directing element (100) associated with the fan wheel;

an internal stator (44) and an external rotor (22), the fan wheel (26; 170) being drivingly connected to the external rotor, said internal stator (44) of said motor being mounted on a first side of the circuit board (17), said fan wheel also being arranged on said first side;

the air-directing element (100) being adapted for mounting on the circuit board (17) separately from the electric motor (18), and having a portion (108) which is adapted to define, together with the circuit board (17), an air conduit (127), so that, in operation, a cooling air flow (13) is generated by the fan wheel (170), which air flow (13) emerges from the fan arrangement (16) and is directed in a targeted manner by the air conduit (127), to thereby cool components in specific sectors on the circuit board (17), which components are arranged at respective locations radially surrounding said air conduit (127), the air flow (13) being correspondingly reduced in sectors where little cooling air is needed;

the motor including a bearing tube (38), the bearing tube (38) having a longitudinal central axis (41) of rotation, and being attached to said internal stator (44) of the motor, so that the bearing tube can be inserted, during assembly of said motor, into said first opening (80) of said circuit board (17) from said first side of the circuit board (17), on which the fan wheel (26; 170) is to be located;

the motor being secured to the circuit board at a plurality of points located within said air conduit (127) defined between said circuit board (17) and said air-directing element (100).

2. The fan arrangement according to claim 1, wherein the air-directing element (100) is formed, on its side facing away from the circuit board (17), with an opening (117, 118) that, after installation of the air-directing element (100) on the circuit board (17), enables installation of the fan wheel (26; 170) and external rotor (22) through that opening.

3. The fan arrangement according to claim 1, wherein the electric motor (18) comprises a rotor shaft (34) supported in a bearing arrangement (36), the bearing arrangement (36, 60, 66) being so shaped that the rotor shaft (34), after its installation, is secured against being pulled out of the bearing arrangement.

4. The fan arrangement according to claim 3, wherein the bearing arrangement (36, 60, 66) comprises at least one radially deflectable stationary retaining element (60) that is implemented for engagement into an annular groove (58) formed on the rotor shaft (34).

5. The fan arrangement according to claim 1, wherein the air-directing element (100) comprises a portion (108) that is adapted to form, together with the circuit board (17), an air conduit (127) with a transverse dimension (L) in a direction which is parallel to the axis (41) of the fan, the transverse dimension (L) widening with increasing radial distance from the axis (41) of the fan.

6. The fan arrangement according claim 1, wherein the air-directing element (100), proceeding from an air entrance side (126), narrows locally in the manner of a Venturi nozzle (118, 117).

7. The fan arrangement according to claim 1, wherein the air-directing element (100) comprises at least one latching element (122) which is adapted for connecting the air-directing element to the circuit board (17).

8. The fan arrangement according to claim 7, wherein the at least one latching element (122) is arranged on the air-directing element (100) and is adapted for latching engagement with an associated cutout (124) formed in the circuit board (17).

9. The fan arrangement according to claim 7, wherein the at least one latching element is a resilient latching hook (122).

10. The fan arrangement according to claim 1, further comprising a plurality of spacing elements (120) which are adapted for defining the size of the air conduit (127) and for being located between the air-directing element (100) and circuit board (17).

11. The fan arrangement according to claim 10, wherein the spacing elements (120) are connected to the air-directing element (100).

12. The fan arrangement according to claim 11, wherein the spacing elements (100) are implemented integrally with the air-directing element (100).

13. The fan arrangement according to claim 1, wherein the fan arrangement has an air entrance (126), further comprising a sealing arrangement (106) provided on the air-directing element (100) adjacent the air entrance (126).

14. The fan arrangement according to claim 1, wherein the fan wheel is implemented as an axial fan wheel (26).

15. The fan arrangement according to claim 14, wherein the axial fan wheel comprises wherein the fan blades and the air-directing element (100) are dimensioned with respect to one another, so that the fan blades (26) extend to the side of the air-directing element portion (108), which is adapted to define, together with the circuit board (17), said air conduit (127), and wherein the fan blades (26) are trapezoidal and, on each of said blades, a first dimension ($x_1$), measured along a radially inner portion (22) thereof, is greater than a second dimension ($x_2$), measured along an outer circumference thereof, in order to improve pressure buildup in a lateral direction of the fan blades (26).

16. The fan arrangement according to claim 15, wherein the fan arrangement has an air entrance (126), the fan blades (26) each have, with reference to a radial section, a curvature with a convex side and an opposite concave side, in which the convex side faces toward the air entrance (126).

17. The fan arrangement according to claim 16, wherein the curvature has a radius (R), and said radius (R) of the curvature is less than or equal to the dimension ($x_1$) of a fan blade (26) on the latter's radially inner side, in order to improve radial outflow (127) of air moved by said blades.

18. The fan arrangement according to claim 1, wherein the fan wheel is implemented as a radial fan wheel (170).

19. The fan arrangement according to claim 18, wherein the radial fan wheel (170) comprises vanes (166) curving backward.

20. The fan arrangement according to claim 19, wherein a vane (166) has, in the region of its outer end, a profile in the radial direction that encloses an angle ($\alpha_2$) with respect to a tangent there to the outer circumference of the fan wheel (170), which angle is less than 90°.

21. The fan arrangement according to claim 19, wherein the vanes (166) are arranged between two air-directing members (172, 174) that together form a curved air-directing conduit which extends from an axial inlet to a radial outlet.

22. The fan arrangement according to claim 21, wherein the vanes (166) are arranged adjacent a radial outlet of the air-directing members (172, 174).

23. The fan arrangement according to claim 1, wherein the bearing tube (38) is adapted to be mounted on the circuit board (17) in such a configuration that it partially extends through the opening (80) provided in the circuit board (17).

24. The fan arrangement according to claim 1, wherein the internal stator of the electric motor is adapted to be soldered directly onto the circuit board (17).

25. The fan arrangement according to claim 1, wherein the electric motor (18) further comprises a collectorless control device including switch elements, said switch elements being adapted for placement on the circuit board (17).

* * * * *